US010615488B2

(12) United States Patent
Liu et al.

(10) Patent No.: US 10,615,488 B2
(45) Date of Patent: Apr. 7, 2020

(54) LINKAGE MECHANISM FOR BASE STATION ANTENNA

(71) Applicant: CommScope Technologies LLC, Hickory, NC (US)

(72) Inventors: Maosheng Liu, Suzhou (CN); ZhaoHui Liu, Suzhou (CN); PuLiang Tang, Suzhou (CN); Ruixin Su, Suzhou (CN); Jun Sun, Suzhou (CN); Junfeng Yu, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/372,771

(22) Filed: Apr. 2, 2019

(65) Prior Publication Data

US 2019/0326663 A1 Oct. 24, 2019

(30) Foreign Application Priority Data

Apr. 24, 2018 (CN) ..... 2018 1 0374081

(51) Int. Cl.

| | |
|---|---|
| ***H01Q 3/36*** | (2006.01) |
| ***H01Q 1/24*** | (2006.01) |
| ***H01Q 21/06*** | (2006.01) |

(52) U.S. Cl.
CPC ..... *H01Q 1/246* (2013.01); *H01Q 3/36* (2013.01); *H01Q 21/061* (2013.01)

(58) Field of Classification Search
CPC ..... H01Q 1/24; H01Q 3/36; H01Q 21/06
See application file for complete search history.

(56) References Cited

U.S. PATENT DOCUMENTS

| | | | | |
|---|---|---|---|---|
| 2002/0126059 | A1* | 9/2002 | Zimmerman | H01Q 1/246 343/757 |
| 2011/0003507 | A1* | 1/2011 | Van Swearingen | B29C 45/16 439/578 |
| 2011/0063049 | A1* | 3/2011 | Bradley | H01P 1/184 333/161 |
| 2017/0365923 | A1 | 12/2017 | Schmutzler et al. | |
| 2018/0034164 | A1* | 2/2018 | Jang | H01Q 9/30 |
| 2018/0227775 | A1 | 8/2018 | Bisiules et al. | |

* cited by examiner

*Primary Examiner* — Michael T Vu
(74) *Attorney, Agent, or Firm* — Myers Bigel, P.A.

(57) ABSTRACT

A linkage device of a linkage mechanism for a base station antenna is integrally formed with: a body; a flange extending outwardly from the body; a mounting portion suspended from the body and configured to mount the linkage device into the base station antenna, and a coupling portion disposed on the body and configured to couple the linkage device to a drive mechanism of the base station antenna, wherein the flange is formed with a guide configured to cause operation of a phase shifter of the base station antenna.

18 Claims, 8 Drawing Sheets

LINKAGE MECHANISM FOR BASE STATION ANTENNA

CROSS-REFERENCE TO RELATED APPLICATION

The present application claims priority under 35 U.S.C. § 119 to Chinese Patent Application No. 201810374081.X (serial No. 2018042500955220), filed, Apr. 24, 2018, the entire content of which is incorporated by reference herein.

FIELD OF THE INVENTION

The present invention generally relates to base station antennas and, more particularly, to linkage mechanisms for base station antennas and to base station antennas including such linkage mechanisms.

BACKGROUND

Base station antennas that operate in multiple frequency bands and that provide omnidirectional coverage are known in the art. These base stations typically operate in one or more portions of the 700 MHz to 5.9 GHz frequency range. Arrays of radio frequency ("RF") radiators that are included in these base station antennas may be mounted on multiple backplanes. In order to support operation in multiple frequency bands, a large number of RF ports and associated feed networks, arrays of radiators, and the like need to be provided. This may result in space constraints within the interior of the base station antenna.

In many cases, some parameters of the antenna need to be adjusted. For example, there may be a need to electronically adjust the elevation or "tilt" angle of the antenna beams generated by the radiators operating in one or more frequency bands. This is accomplished by adjusting the phase of the sub-components of an RF signal that are radiated through each of the radiating elements. In cases where the antenna provides omnidirectional coverage, it will typically be necessary to adjust the phase with respect to radiators that are mounted on multiple backplanes. Typically, all of these radiators are adjusted synchronously to ensure that consistent phase adjustment is achieved.

Mechanisms are known in the art that may accomplish synchronous adjustment of the phase for radiators that are mounted on multiple backplanes. However, in order to adapt to the complex space environment inside the antenna, these mechanisms are typically composed of multiple components, resulting in a large apparatus and difficult and time-consuming assembly, and the apparatus may also complicate the design and assembly of other internal components of the antenna.

SUMMARY

According to a first aspect of the present disclosure, a linkage device of a linkage mechanism for a base station antenna is provided. The linkage device includes a body, a flange extending outwardly from the body, a mounting portion extending from the body and configured to mount the linkage device within the base station antenna, and a coupling portion that is configured to couple the linkage device to a drive mechanism. The flange includes a guide that is coupled to a moveable element of a phase shifter of the base station antenna.

The linkage device may comprise an integral or "monolithic" structure. The monolithic nature of the linkage device may reduce the weight and the cost of the base station antenna, simplify the assembly process, and reduce the number of specialized tools required for assembly. The use of a monolithic linkage device may also reduce tolerances and therefore improve the accuracy of the phase shifter.

In some embodiments, the flange may include first and second portions, and the guide may be formed between the first and second portions. The first and second portions may extend substantially parallel to each other, with a gap defined therebetween, and the edges of the first and second portions that define the gap may serve as the guide. One or more ribs may extend between the first portion and the second portion to connect the first portion and the second portion.

In some embodiments, the linkage device may include a plurality of flanges, each of which includes at least two guides. These guides may all be in the same plane or on the same curved surface. In one specific embodiment, the linkage device may include four flanges that each include two guides.

In some embodiments, the coupling portion may be provided on a side of the body that is opposite the mounting portion.

The linkage device may be part of a linkage mechanism for a base station. The linkage mechanism may further include a support device to which the mounting portion of the linkage device is slidably mounted. In some embodiments, the support device may have an L-shape so as to have a longitudinal portion and a lateral portion, and the mounting portion of the linkage device may be slidably mounted to the lateral portion. In some embodiments, the lateral portion may include a mounting hole, and the mounting portion of the linkage device may pass through the mounting hole and can slide relative to the mounting hole. The mounting hole may optionally include a bushing, and the mounting portion of the linkage device may engage the bushing and can slide relative to the bushing.

The linkage mechanism may be part of a base station antenna that includes a plurality of backplanes that together define an internal space and a phase shifter that includes a wiper support. The phase shifter is mounted on a first of the backplanes, and the linkage mechanism may be mounted within the internal space. The wiper support of the phase shifter may be received within the guide of the linkage device such that movement of the linkage device causes movement of the wiper support.

In some embodiments, the wiper support includes a guide pin that is received within the guide and is configured to be slidable in the guide during operation of the linkage mechanism.

According to another aspect of the present disclosure, a method for assembling the above-mentioned base station antenna is provided, including the steps of (a) mounting the phase shifters on the plurality of backplanes, (b) interconnecting first backplanes of the plurality of backplanes, (c) fixing the longitudinal portion of the support device of the linkage mechanism to one of the first backplanes, (d) mounting the linkage device to the support device, (e) engaging the wiper support of the phase shifter on the first backplane correspondingly with the guide of the flange of the linkage device and (f) assembling a second backplane in the plurality of backplanes with the first backplanes to form an internal space of the base station antenna so that the linkage mechanism is located within the internal space, and meanwhile engaging the wiper support of the phase shifter on the second backplane correspondingly with the guide of the flange of the linkage device.

Pursuant to still further embodiments of the present invention, base station antennas are provided that include at least three backplanes, each backplane having an array of first frequency band radiating elements extending forwardly therefrom, a plurality of phase shifters, each phase shifter configured to adjust a downtilt angle of an antenna beam formed by a respective one of the arrays of first frequency band radiating elements, each phase shifter including a main board, a wiper and a wiper support that mounts the wiper for movement with respect to the main board, a remote electronic tilt ("RET") actuator, and a linkage mechanism that extends between the RET actuator and each of the phase shifters, wherein the linkage mechanism includes a linkage device and a coupling portion that connects the linkage device to the RET actuator.

In some embodiments, each wiper support is mounted within a respective guide of the linkage device and each wiper support is configured to move within its respective guide in response to movement of the linkage device. In some embodiments, first and second of the phase shifters may be mounted on a first of the backplanes and third and fourth of the phase shifters may be mounted on a second of the backplanes, where a first distance between a first location where the wiper support of the first phase shifter connects to the linkage device and a second location where the wiper support of the second phase shifter connects to the linkage device is greater than a second distance between the first location and a third location where the wiper support of the third phase shifter connects to the linkage device. In some embodiments, the linkage mechanism includes a plurality of flanges and a coupling portion that connects to the RET actuator, and a first of the wiper supports that is part of a first of the phase shifters is mounted on a first of the flanges, and a second of the wiper supports that is part of a second of the phase shifters is also mounted on the first of the flanges, and the first of the phase shifters is configured to adjust the downtilt angle of the antenna beam formed by a first of the arrays of first frequency band radiating elements that is mounted on a first of the backplanes, and the second of the phase shifters is configured to adjust the downtilt angle of the antenna beam formed by a second of the arrays of first frequency band radiating elements that is mounted on a second of the backplanes.

DETAILED DESCRIPTION

The present invention is described below with reference to the accompanying drawings, in which certain embodiments of the invention are shown. However, it is to be understood that the present invention may be embodied in many different forms and should not be construed as limited to the embodiments that are pictured and described herein. Rather, these embodiments are provided so that this disclosure will be thorough and complete, and will fully convey the scope of the invention to those skilled in the art. It will also be appreciated that the embodiments disclosed herein can be combined in any way to provide many additional embodiments.

Like numbers refer to like elements throughout. In the figures, the thickness of certain lines, layers, components, elements or features may be exaggerated for clarity.

As used herein, the singular forms "a", "an" and "the" are intended to include the plural forms as well, unless the context clearly indicates otherwise. It will be further understood that the terms "comprise" and "includes" and variants thereof, when used in this specification, specify the presence of stated elements, operations and/or components, but do not preclude the presence or addition of one or more other elements, operations, components, and/or groups thereof. As used herein, the term "and/or" includes any and all combinations of one or more of the associated listed items.

It will be understood that when a first element is referred to as being "on," "attached to," "connected to," "coupled to" and/or "contacting", etc., a second element, the first element can be directly on, attached to, connected to, coupled to or contacting the other element or intervening elements may also be present. In contrast, when an element is referred to as being, for example, "directly on", "directly attached" to, "directly connected" to, "directly coupled" with or "directly contacting" another element, there are no intervening elements present.

Spatially relative terms, such as "under", "below", "lower", "over", "upper", "lateral", "left", "right" and the like, may be used herein for ease of description to describe one element or feature's relationship to another element or feature as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Figure 1:
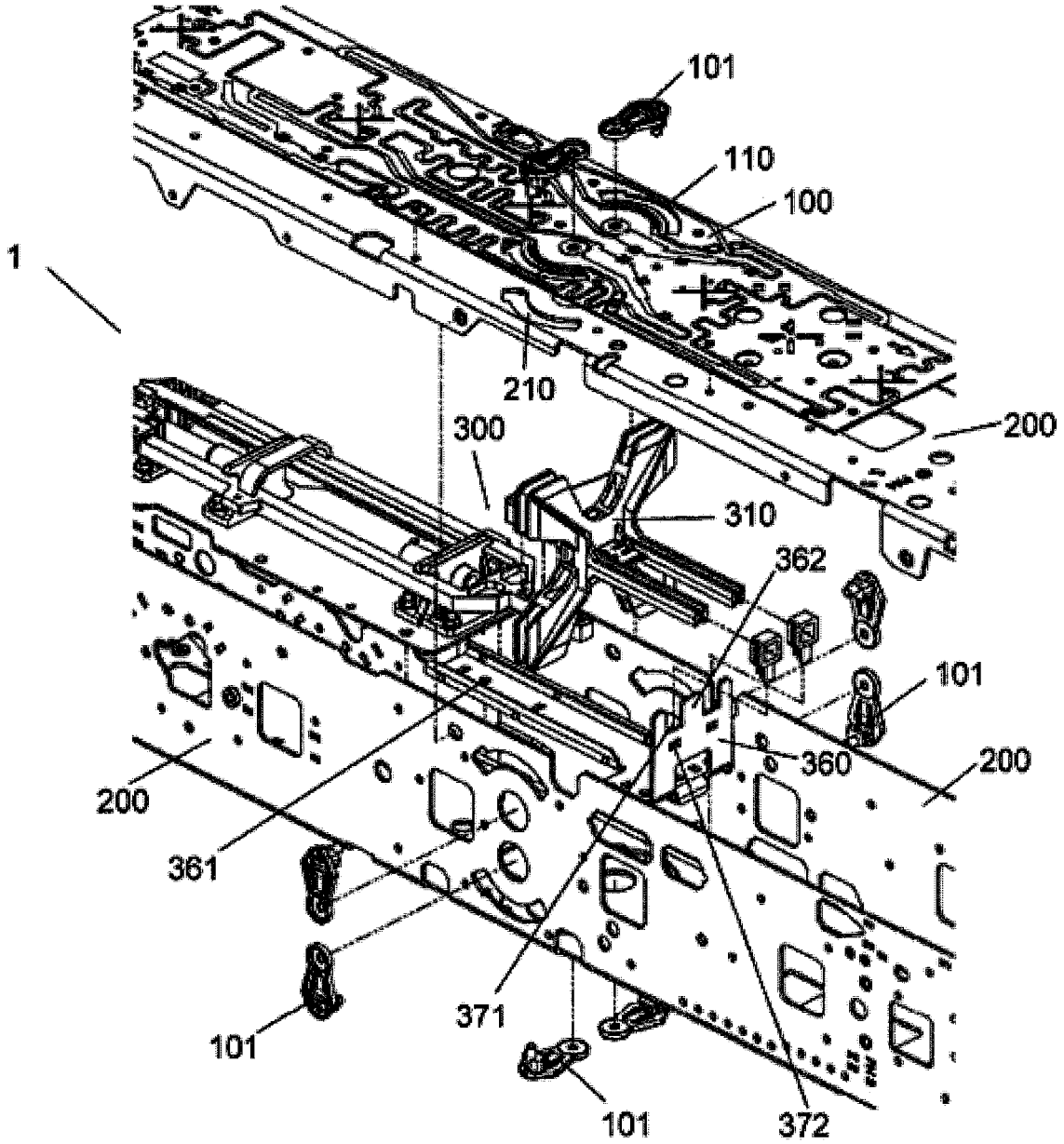
FIG. 1 is an exploded perspective view of a portion of a base station antenna according to embodiments of the present invention.

Referring to FIG. 1, a base station antenna 1 according to embodiments of the present invention is shown. For ease of description, the direction along the length of base station antenna 1 is defined as a longitudinal direction, the direction extending outward from and perpendicular to a center line of base station antenna 1 is defined as a radial direction, and the direction perpendicular to the longitudinal direction is defined as a lateral direction.

The base station antenna 1 includes a plurality of electromechanical phase shifters 100, a plurality of backplanes 200, and a linkage mechanism 300. The phase shifters 100 are mounted on the backplanes 200, and the linkage mechanism 300 is configured to mechanically drive the phase shifters 100.

The backplanes 200 may be assembled together to form a housing that defines an internal space, and the linkage mechanism 300 is typically mounted within this internal space. The side of each backplane 200 that faces the internal space is an inner side surface, and the side facing away from the internal space is the outer side surface. In the illustrated embodiment, four backplanes 200 are provided; however, it will be appreciated that the number of backplanes 200 is not limited thereto, and that the number of backplanes 200 (e.g., three, five, six, eight, etc.) can be set according to the actual application requirements. While the description below focuses on an embodiment that includes four backplanes, it will be understood that the description is also applicable to antennas including other numbers of backplanes 200.

In the illustrated embodiment, the phase shifters 100 are mounted on the outer side surfaces of the backplanes 200; however, the phase shifters 100 may also be mounted elsewhere such as, for example, on the inner side surfaces of the respective backplanes 200. In the illustrated embodiment, two phase shifters 100 are mounted on each backplane 200; however, this is not restrictive either, and the number of phase shifters 100 mounted on each of the backplanes can be set according to the actual application requirements.

Each phase shifter 100 has a wiper support 101. Physical movement of the wiper support 101 results in the phase shift operation. The linkage mechanism 300 according to the present disclosure is used to physically move the wiper support 101. The phase shifter 100 may be, for example, a rotary phase shifter or a sliding phase shifter. In the case of a sliding phase shifter, the wiper support slides along an axis to perform the phase shift operation, whereas in the case of a rotary phase shifter, the wiper support rotates about a pivot point to perform the phase shift operation. In the illustrated embodiment, the rotary phase shifter is described as an example, but it will be understood that the present invention is also applicable to other types of phase shifters such as the sliding phase shifter.

Figure 5:
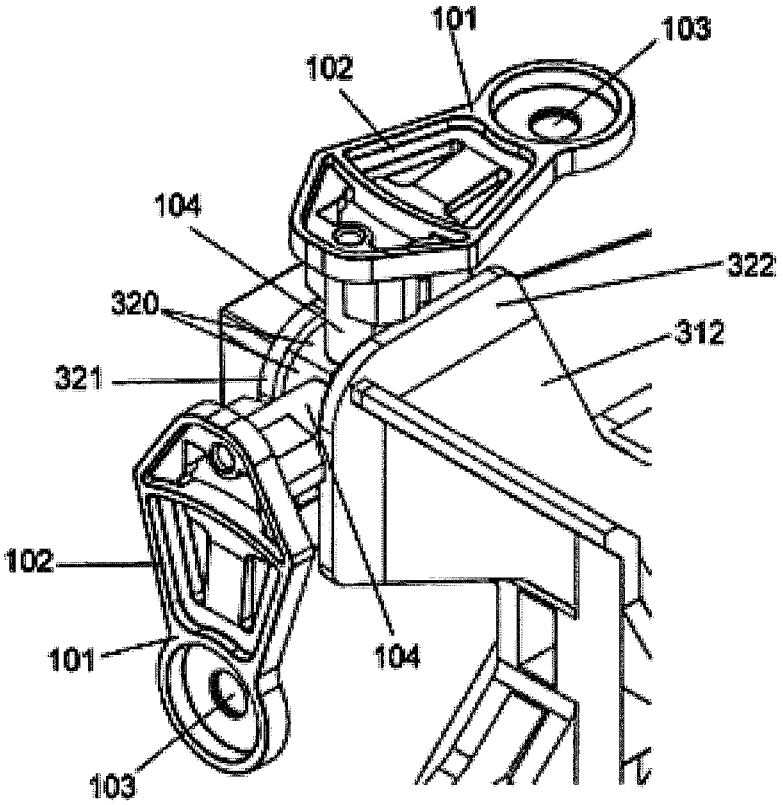
FIG. 5 is an enlarged view of one of the flanges of the linkage device of FIGS. 3-4, showing two wiper supports of the phase shifter engaged with the flange.

As shown in FIG. 5, the wiper support 101 includes a body 102, which is provided with a shaft hole 103 at one end and with a guide pin 104 at the other end. During operation, the linkage mechanism 300 causes the guide pin 104 to move such that the wiper support 101 rotates about the shaft hole 103.

Each phase shifter 100 may include a base board, which may be a printed circuit board. As shown in FIG. 1, slots 110 are provided in the respective base printed circuit boards of the phase shifters 100, and slots 210 are formed at corresponding positions of the backplanes 200. The guide pins 104 are inserted through the respective slots 110 and 210 to extend into the internal space of the base station antenna 1 so as to engage the linkage mechanism 300. The slots 110 and 210 may be arcuate-shaped slots so that the guide pin 104 can move along the slots 110, 210 as they rotate about the respective shaft holes 103.

The linkage mechanism 300 includes a linkage device 310 and a support device 360. The linkage mechanism 300 and its relationship with other components of the base station antenna 1 will be described in detail below with reference to FIGS. 2-5.

Figure 2:
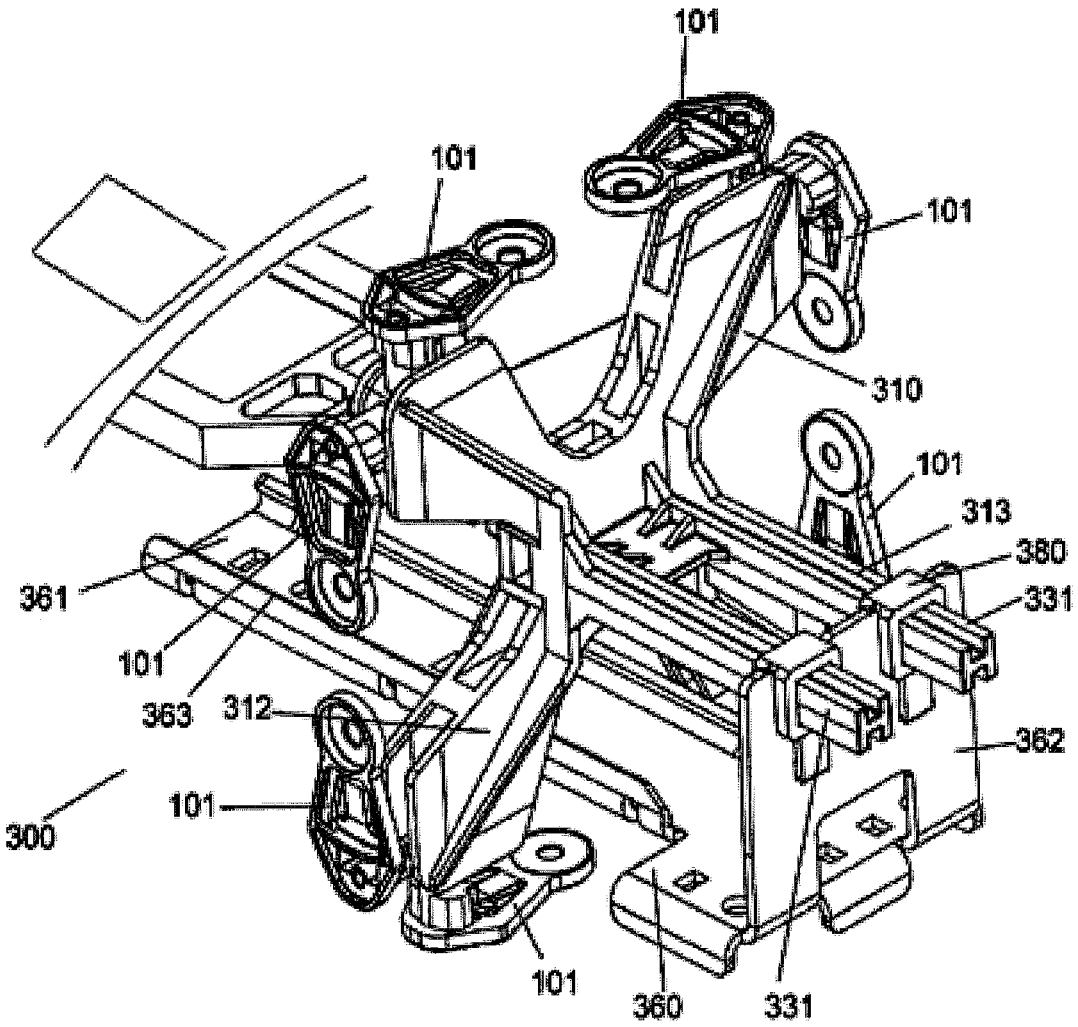
FIG. 2 is a perspective view of the linkage mechanism included in the base station antenna of FIG. 1, illustrating its coupling with a shaft of a motor of the base station antenna.
Figure 3:
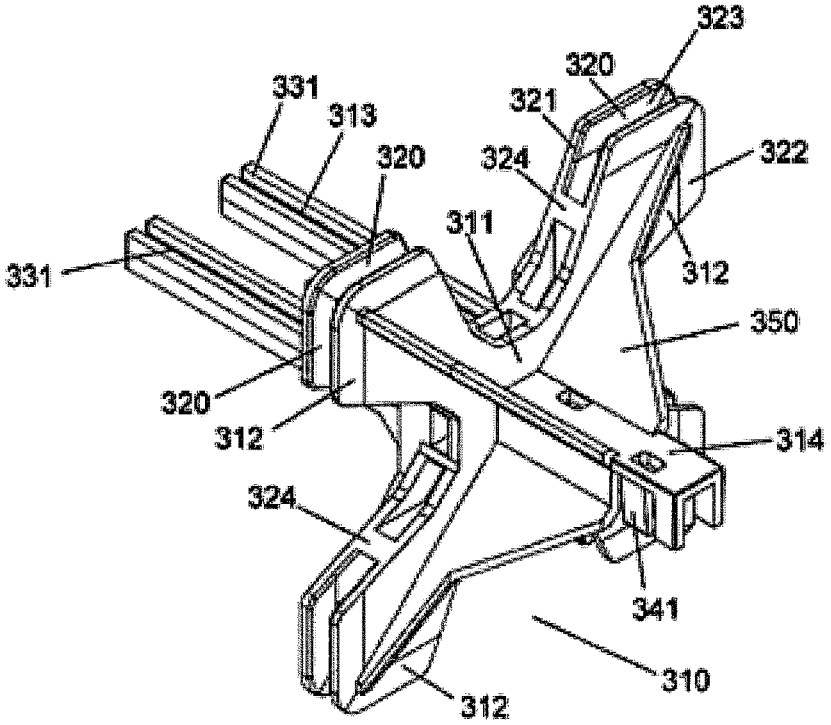
FIG. 3 is a perspective view of the linkage device of the linkage mechanism of FIG. 2.

As shown in FIGS. 2 and 3, the linkage device 310 may be an integral or "monolithic" component that can be formed, for example, by injection molding. The linkage device includes a body 311, flanges 312, one or more mounting portions 313, and a coupling portion 314.

Figure 8A:
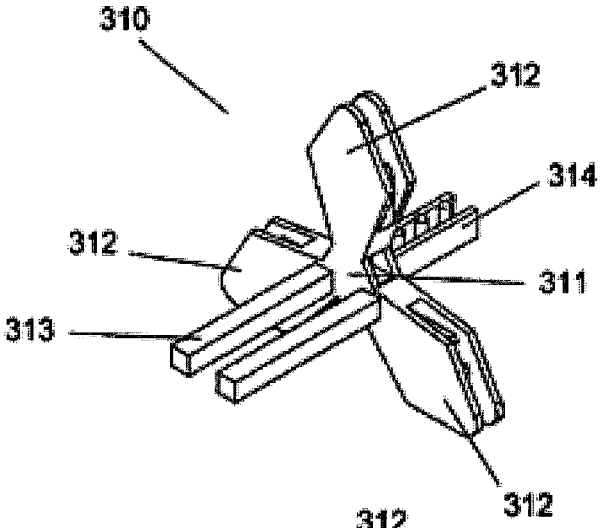
FIGS. 8A to 8C show several linkage devices according to additional embodiments of the present invention.
Figure 8B:
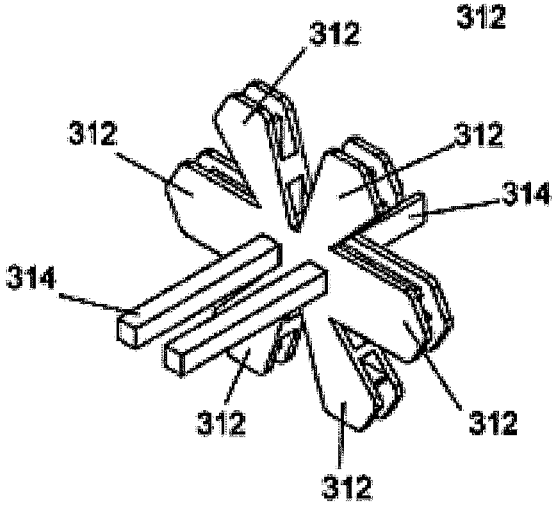
Figure 8C:
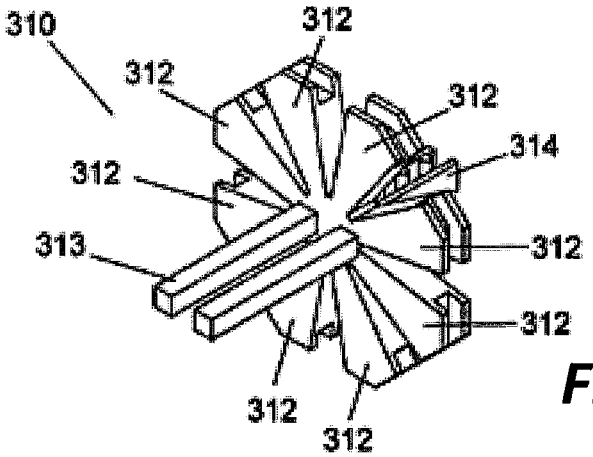

The flanges 312 extend outwardly from the body 311, for example, in a generally radial direction. In the embodiment shown in FIG. 3, the linkage device 310 includes four flanges 312 that correspond to the four backplanes 200, respectively. The four flanges 312 are arranged around the body 311 at substantially equal intervals, i.e., two adjacent flanges 312 define an angle of approximately 90 degrees. It will be appreciated, however, that the number of flanges 312 may be varied (e.g., three, five, six, eight, etc.) in order to meet actual application requirements. For example, FIGS. 8A-8C illustrate alternative embodiments where the linkage device 310 has different numbers of flanges 312. The number of flanges 312 may substantially correspond to the number of backplanes 200.

In the illustrated embodiment, all of the flanges 312 have substantially the same configuration, but those skilled in the art can appreciate that the flanges may also use different configurations that can be used for guiding the guide pin 104 of the wiper support 101.

Each flange 312 may include a guide 320 that is configured to engage the guide pin 104 of the wiper support 101. Consequently, movement of the linkage device 310 (and hence the flange 312) causes movement of the guide pin 104 to thereby enable operation of the phase shifter 100.

Each flange 312 may include two portions, a first portion 321 and a second portion 322, and the guide 320 is formed between the first portion 321 and the second portion 322. In an embodiment, the first portion 321 and the second portion 322 may be arranged substantially parallel to each other, thereby defining a gap 323 in between, and the edges of the first portion 321 and the second portion 322 that define the gap 323 serve as the guide 320. The guide pin 104 of the wiper support 101 may be inserted into the gap 323 and may be slidably mounted within the gap 323 (i.e., the guide pin 104 may slide within the gap 323).

In order to facilitate forming the linkage device 310 via injection molding, one or more ribs 324 may be provided between the first portion 321 and the second portion 322, and the first portion 321 and the second portion 322 may be connected to each other through the ribs 324.

In some embodiments, the body 311 and the flanges 312 may be formed together by two sheet components, and ribs are provided between said two sheet components for connecting them together. Such configuration facilitates the integral molding of the linkage device 310, reducing the weight and cost of the linkage device 310.

Each flange 312 may include one or more guides 320, for example, at least two guides 320, and the number of guides may be set according to the actual application requirements. In the illustrated embodiment, each flange 312 includes two guides 320, so the four flanges 312 provide a total of eight guides 320.

In the illustrated embodiment, all of the guides 320 are located in a common plane that is perpendicular to the longitudinal direction. The arrangement of the guides 320 may correspond to the locations of the respective wiper supports 101 and with the desired movement of the wiper supports 101. For example, the guides 320 may have a staggered arrangement or be at an angle to each other in the longitudinal direction so as to accommodate different locations of the wiper supports 101. Alternatively, the guides 320 may be located on a curved surface in order to obtain the desired relative movement.

The mounting portions 313 may be structures that extend from the body 311 that are used to mount the linkage device 310 within the base station antenna 1. In the illustrated embodiment, two mounting portions 313 extend from a side of the body 311 in the longitudinal direction. The mounting portions 313 may be in the form of mounting rods 331, such as elongate rod-shaped objects. In the illustrated embodiment, the linkage device 310 includes two mounting rods 331, but it will be appreciated that the number of the mounting rods 331 is not limited thereto and can be set according to the actual application requirements.

The coupling portion 314 is disposed on the body 311 and is configured to couple the linkage device 310 to a drive mechanism 340 of the base station antenna 1 so that the drive mechanism 340 can drive the linkage device 310 to move, for example, in the longitudinal direction.

The coupling portion 314 may be disposed on a side of the body 311 that is the same side or a side that is opposite the side where the mounting portions 313 are disposed. For example, in the illustrated embodiment, the coupling portion 314 is disposed on a side of the body 311 that is opposite the mounting portions 313. The coupling portion 314 may be coupled to the drive mechanism 340 in any suitable way. For example, the coupling portion 314 may include a snap member 341, the drive mechanism 340 may include a snap-fitting portion, and the snap member 341 may be snap-fitted into the snap-fitting portion of the drive mechanism 340 to connect the coupling portion 314 to the drive mechanism 340.

In some embodiments, the linkage device 310 may also be provided with ribs 350 to increase the structural strength of the linkage device 310. In the illustrated embodiment, a plurality of ribs 350 are disposed between the flange 312 and the coupling portion 314. It can be anticipated by those skilled in the art that the ribs 350 may also be provided at other positions of the linkage device 310 so as to increase the structural strength of the linkage device 310.

Figure 4:
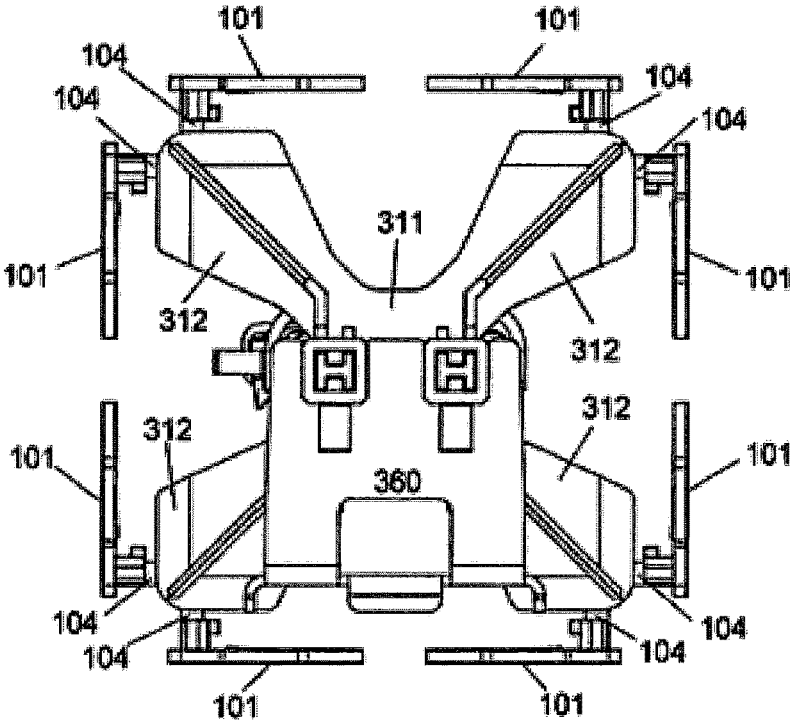
FIG. 4 is a side view of the linkage mechanism of FIG. 3 with the backplanes of the base station antenna shown to provide context.

FIGS. 4 and 5 illustrate the engagement of the wiper supports 101 with the linkage device 310, where FIG. 4 is a side view of the linkage mechanism 300, showing how the wiper supports 101 connect to the linkage device 310, and FIG. 5 is an enlarged view of one of the flanges 312 of the linkage device 310 showing how the guide pins 104 of the wiper supports 101 engage the flange 312.

The guide pin 104 is inserted into and can slidably move within the guide 320 of the flange 312. When the drive mechanism 340 drives the linkage device 310 to move in the longitudinal direction, the flanges 312 move in the longitudinal direction so that the guide pin 104, which is engaged within the guide 320, is driven to move in the longitudinal direction. While moving in the longitudinal direction, the guide pin 104 can slide within the guide 320 as the wiper support 101 rotates about the shaft hole 103 through the guide pin 104, so that the phase shifter 100 that includes the wiper support 101 performs a phase shift operation.

As shown in FIGS. 1 and 2, the support device 360 is configured to support the linkage device 310, and the linkage device 310 is mounted on the support device 360 and can move relative to the support device 360. Specifically, the mounting portions 313 of the linkage device 310 may be slidably mounted to the support device 360.

The support device 360 may have any suitable shape and configuration. In the illustrated embodiment, the support device 360 has an L-shape and includes a longitudinal portion 361 extending in the longitudinal direction and a lateral portion 362 extending in the lateral direction. The mounting portion 313 is mounted to the lateral portion 362.

The lateral portion 362 is provided with mounting holes 371 for accommodating the respective mounting portions 313 of the linkage device 310, which may extend through the mounting holes 371 and which can slide therein relative to the mounting holes 371. In the illustrated embodiment, the lateral portion 362 includes two mounting holes 371 that correspond to the two mounting rods 331 of the linkage device 310, and each mounting rod 331 passes through a respective one of the mounting holes 371.

In order to avoid wearing and facilitate sliding of the mounting rod 331 relative to the mounting hole 371, bushings 380 may be provided. Each bushing 380 is fixed to a respective one of the mounting holes 371, and each mounting portion 313 passes through and can slide relative to a respective one of the bushings 380. In this case, the mounting portions 313 do not directly contact the respective mounting holes 371, avoiding wearing of the components, and the bushings 380 can contribute to the sliding of the respective mounting portions 313.

In order to facilitate fixing the bushings 380 to the respective mounting holes 371, the mounting holes 371 may be in the form of an opening. Upon fixing the bushing 380, the bushings 380 are directly inserted from an open end of their respective mounting holes 371. Further, each lateral portion 362 may be provided with a snap hole 372, and each bushing 380 may be provided with a snap member, so that when the bushings 380 are inserted into their respective mounting holes 371, the snap members of the respective bushings 380 can be directly snap-fitted into the snap holes 372 of the lateral portion 362 to thereby secure the bushings 380 in place.

The longitudinal portion 361 may include a guide rail 363, which may be configured to receive and guide at least some of the cables that extend within the base station antenna 1. The guide rail 363 may facilitate neatly arranging the cables, which may help to effectively utilize the limited space within the base station antenna 1.

According to another aspect of the present disclosure, a method for assembling the base station antenna 1 is provided, which is illustrated with reference to FIGS. 6A to 6E.

Figure 6A:
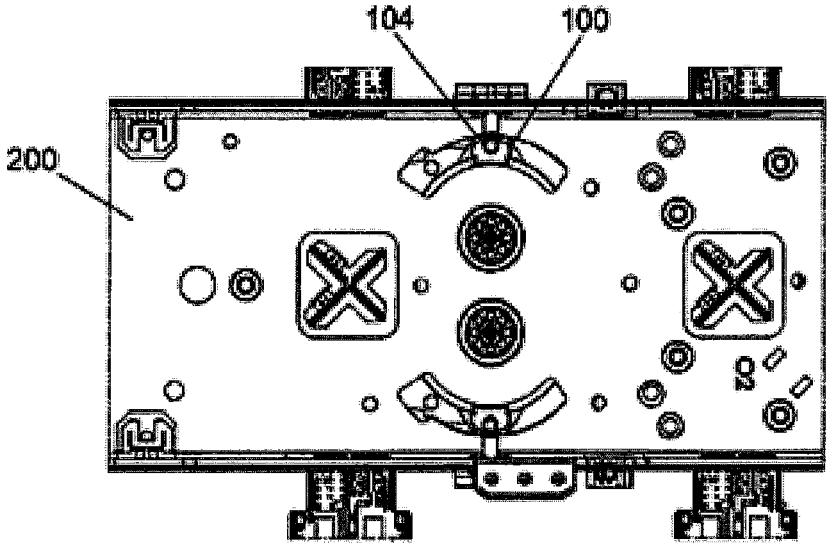
FIGS. 6A to 6E are schematic views illustrating a method for assembling the base station antenna of FIG. 1.

As shown in FIG. 6A, the phase shifters 100 are mounted on the backplanes 200. After the phase shifters 100 are mounted, the guide pins 104 of the respective wiper supports 101 are inserted through the respective slots 110 of the phase shifter 100 and the slots 210 of the backplane 200.

Still referring to FIG. 6A, at least some of the backplanes 200 may be interconnected. For example, in the illustrated embodiment, three of the backplanes 200 are interconnected to form a generally U-shaped structure, which is open at one side because the last backplane 200 has not yet been connected to the other three backplanes 200.

Figure 6B:
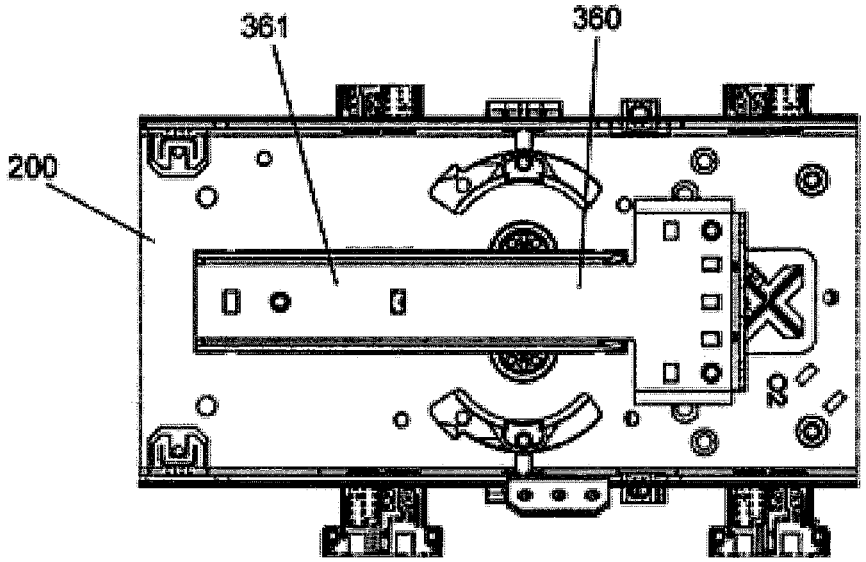

As shown in FIG. 6B, the longitudinal portion 361 of the support device 360 of the linkage mechanism 300 is fixed to one of the backplanes 200 so that the longitudinal portion 361 extends in the longitudinal direction.

Figure 6C:
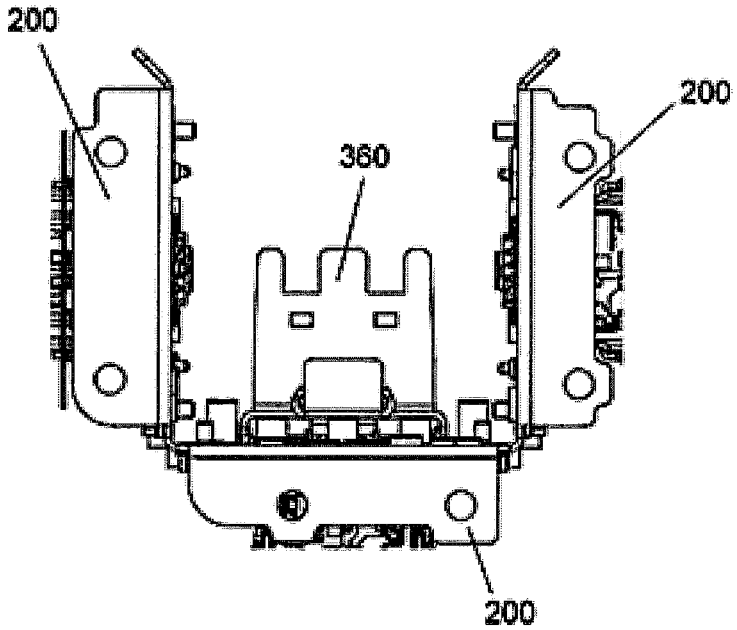

As shown in FIG. 6C, after the support device 360 is fixed to the backplane 200, wiring may be performed using the guide rail 363 on the longitudinal portion 361 of the support device 360.

Figure 6D:
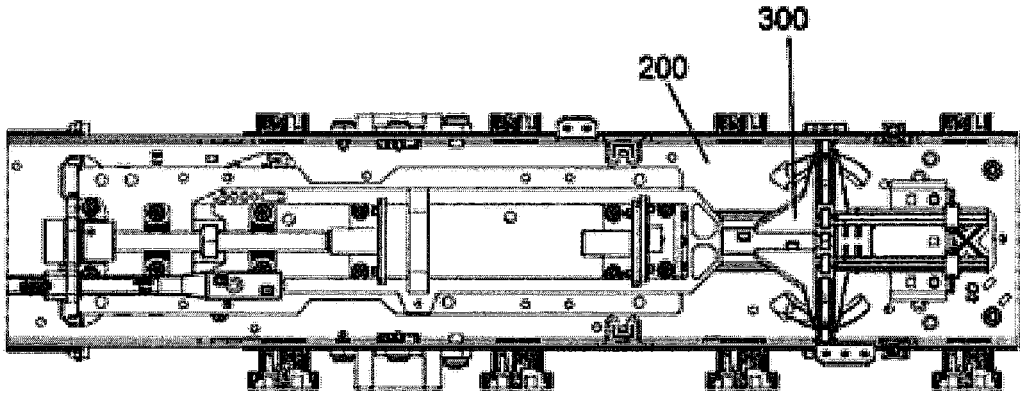

As shown in FIG. 6D, the linkage device 310 is mounted to the support device 360. For example, the bushings 380 may be inserted into the respective mounting holes 371 of the lateral portion 362 such that the snap members of the bushings 380 can be directly snap-fitted into the snap holes 372 of the lateral portion 362 to secure the bushings 380 in place. The mounting portions 313 are then inserted through the respective bushings 380 so that the linkage device 310 is slidably mounted to the supporting device 360. Alternatively, the mounting portions 313 may be inserted through the respective bushings 380 first, and then the bushings 380 may be inserted into the respective mounting holes 371 of the lateral portion 362 so that the snap members of the bushings 380 can be directly snap-fitted into the snap holes 372 of the lateral portion 362, thereby slidably mounting the linkage device 310 to the support device 360.

In addition to the step of wiring using the guide rail 363, the above-mentioned steps may be performed interchangeably, that is, there is no limitation on the order of execution of the respective steps. For example, the support device 360 may be fixed to one of the backplanes 200 before several of the backplanes 200 are interconnected, or the linkage device 310 may be mounted to the support device 360 first and then the support device 360 mounted with the linkage device 310 fixed thereto may be mounted on one of the backplanes 200, or the phase shifter 100 may be mounted to the backplane 200 at the last step, etc. The order of assembly can be selected based on actual requirements or operating specifications, and is not restrictive.

As is further shown in FIG. 6D, the wiper supports 101 on the assembled backplanes 200 are engaged with the respective guides 320 of the flanges 312 of the linkage device 310. Specifically, the guide pins 104 are inserted into their respective guides 320 such that the guide pins 104 can move in the longitudinal direction along with the movement of the linkage device 310 and can slide within their respective guides 320 at the same time.

Figure 6E:
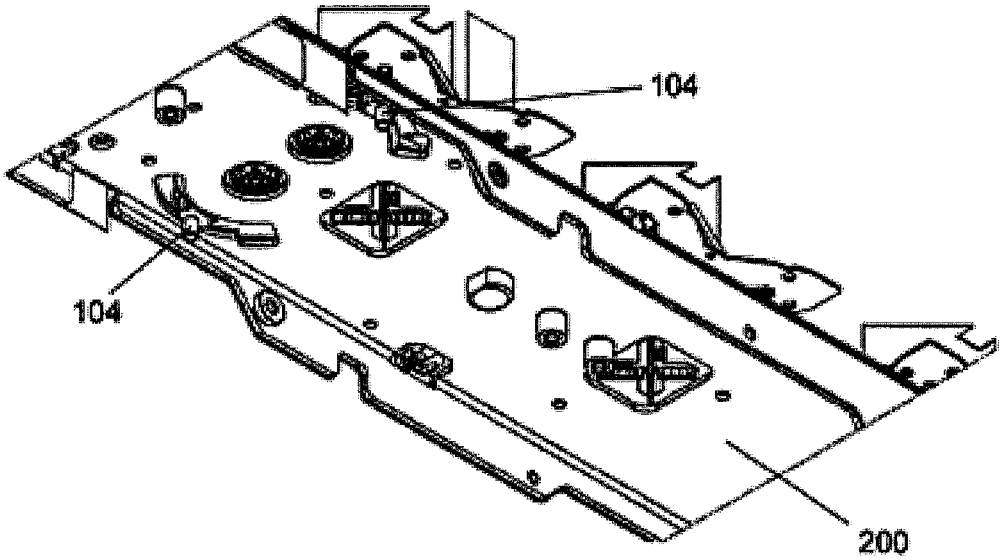

As shown in FIG. 6E, the remaining backplane 200 may then be connected to the previously assembled backplanes 200 to form an internal space of the base station antenna 1 such that the linkage mechanism 300 is located in the internal space, and the wiper supports 101 for the phase shifters that are mounted on the remaining backplane are engaged with the corresponding guides 320 of the flanges 312 of the linkage device 310. Specifically, the guide pins 104 of the wiper supports 101 are inserted into the guides 320 such that the guide pins 104 can move in the longitudinal direction along with the movement of the linkage device 310 and can slide within the respective guides 320 at the same time.

The above-described step of engaging the wiper supports 101 with the corresponding guides 320 and the step of mounting the remaining backplane 200 to the previously-assembled backplanes 200 may be performed interchangeably or simultaneously, and this can be selected based on actual requirements or operating specifications.

Pursuant to embodiments of the present disclosure, base station antennas are provided that include at least three backplanes. Each backplane may comprise, for example, a metal sheet that serves as a reflector and/or as a ground plane for the antenna. Each backplane includes an array (e.g., a linear array) of first frequency band radiating elements mounted thereon. A respective electromechanical phase shifter may be mounted on the RF path that extends between each array of first frequency band radiating elements and an RF port of the antenna. Each of these phase shifters may be used to adjust a downtilt angle of an antenna beam that is formed by the array of first frequency band radiating elements that is associated with the respective phase shifter. Each phase shifter may include a main printed circuit board, a wiper printed circuit board and a wiper support that mounts the wiper printed circuit board for movement with respect to the main printed circuit board. In an exemplary embodiment, each phase shifter may comprise a rotary phase shifter in which the wiper printed circuit board is rotated along an arc above the main printed circuit board to change the downtilt angle of the antenna beam formed by the array of first frequency band radiating elements that is associated with the phase shifter. It will be appreciated, however, that other types of electromechanical phase shifters may be used such as sliding dielectric type phase shifters or trombone style phase shifters.

The base station antenna further includes a manual tilt or remote electronic tilt ("RET") actuator and a linkage mechanism that connects the RET actuator to the phase shifters that are mounted on multiple of the at least three backplanes. The RET actuator may thus be actuated to adjust phase shifters on multiple of the backplanes to modify a downtilt angle of the antenna beam generated by the arrays of first frequency band radiating elements that are mounted on those backplanes.

In some embodiments, the linkage mechanism may comprise a linkage device and a coupling portion that connects the linkage device to the RET actuator. The coupling portion may be one or more separate components or may be formed integrally with the linkage device. In some embodiments, the linkage device may include a plurality of flanges. For example, the linkage device may include at least three flanges. Each flange may include at least one guide, and a respective one of the wiper supports may be mounted in each guide. In some embodiments, each flange may have first and second components that define an internal lip therebetween. The internal lip may define one or more guides, and each guide may receive a pin or other protruding member of a respective one of the wiper supports. This pin may extend from a distal portion of the wiper support so that movement of the pin may cause the wiper support to pivot about its base. In embodiments in which the flanges include multiple guides, the guides may be separate guides or may be separate parts of a single continuous guide.

When the RET actuator is activated, linear movement of the RET actuator is transferred to the linkage device via the coupling portion. As the linkage device moves, the pins of each wiper support move, causing each wiper support to rotate about its respective pivot point. As the wiper supports rotate, the pins of the wiper supports move within their respective guides in the flanges of the linkage device.

In some embodiments, first and second of the phase shifters may be mounted on a first of the backplanes and third and fourth of the phase shifters may be mounted on a second of the backplanes. The first and third phase shifters may be used to adjust the downtilt angle of the antenna beams formed by the −45° dipoles of the radiating elements in the respective first and third arrays of radiating elements, and the second and fourth phase shifters may be used to adjust the downtilt angle of the antenna beams formed by the +45° dipoles of the radiating elements in the respective second and fourth arrays of radiating elements. A first distance may be defined between a first location where the wiper support of the first phase shifter connects to the linkage device and a second location where the wiper support of the second phase shifter connects to the linkage device. A second distance may be defined between the first location and a third location where the wiper support of the third phase shifter connects to the linkage device. The first distance may exceed the second distance. This arrangement is possible because wiper supports associated with phase shifters that are mounted on different ones of the backplanes may be mounted in the same flange of the linkage device. In other words, a first of the wiper supports that is part of a first of the phase shifters may be mounted on the same flange as is a second of the wiper supports that is part of a third of the phase shifters, where the first and third phase shifters are associated with arrays of radiating elements that are mounted on different backplanes of the antenna.

Figure 7:
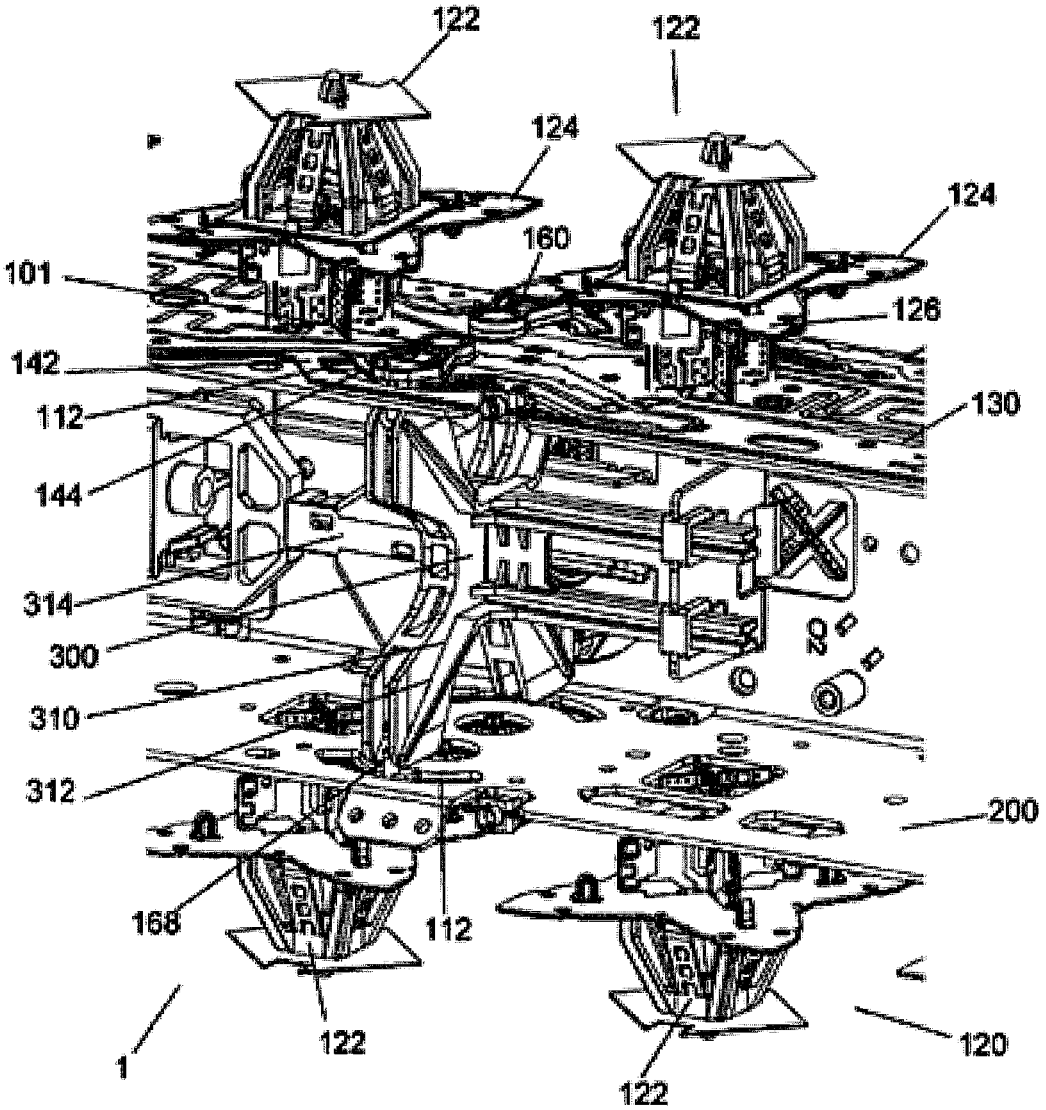
FIG. 7 is a partial perspective view of the fully assembled base station antenna of FIG. 1 with one backplane removed for the purpose of clarity.

Referring now to FIG. 7, a portion of a base station antenna 1 according to an embodiment of the present disclosure is shown. The base station antenna 1 includes four backplanes 200 that are arranged to form a rectangular tube. Note that in FIG. 1 one of the backplanes 200 (the "front" backplane 200 in the view of FIG. 1) has been removed to show the interior of the antenna 1, and another of the backplanes 200 (the rear backplane 200) is not visible in the figure. The four backplanes 200 may be identical and the same structures (e.g., radiating elements, feed boards, phase shifters, etc.) may be mounted on each backplane 200, so it will be understood that the sides of the antenna 1 that are omitted/not visible in FIG. 1 may be identical to the sides of the antenna 1 that are shown.

As shown in FIG. 7, a respective array 120 of first frequency band radiating elements 122 is mounted on each backplane 200. In the depicted embodiment, each first frequency band radiating element 122 is implemented as a pair of slant −45°/+45° cross-dipole radiating elements. As known to those of skill in the art, when slant −45°/+45° cross-dipole radiating elements are used, the −45° dipoles 124 of the cross-dipole radiating elements 122 in each array 120 form a first (−45° polarization) antenna beam and the +45° dipoles 126 of the cross-dipole radiating elements 122 in each array 120 form a second (+45° polarization) antenna beam. Thus, when cross-dipole (or other dual-polarized) radiating elements 122 are used, each set of dipoles 124, 126 (e.g., the set of −45° dipoles and the set of +45° dipoles) may be viewed as a separate array of radiating elements. The radiating elements 122 of each array 120 may be mounted on one or more feed board printed circuit boards 130 (referred to herein as feed boards 130).

For each array 120 of first frequency band radiating elements 122, the −45° dipole of each cross-dipole radiating element 122 in the array 120 connect to a first phase shifter 100, and the +45° dipole 126 of each cross-dipole radiating element 122 in the array 120 connect to a second phase shifter 100. Each phase shifter 100 may be implemented as a rotary wiper flange phase shifter that includes a main printed circuit board 142, a wiper printed circuit board 144, and a wiper support 101 that mounts the wiper printed circuit board 144 for rotational movement with respect to the main printed circuit board 142. The wiper support 101 may include a body 102 and a pin (or other protrusion) 104 that extends from the body 102 toward the interior of antenna 1. A first end of the body 102 may be pivotally mounted to the main printed circuit board 142.

In the depicted embodiment, the main printed circuit board 142 of each phase shifter 100 may be implemented in one of the feed boards 130. In this embodiment, the radiating elements 122 of each array 120 are all mounted on a common feed board 130, and each feed board 130 is mounted on the outer face of a respective one of the backplanes 200. Each wiper support 101 mounts a respective wiper printed circuit board 144 for rotational movement with respect to the main printed circuit board 142. The main printed circuit board 142 is positioned between the backplane 200 on which it is mounted and the wiper printed circuit board 144. As shown, two phase shifters 100 are implemented on each feed board 130. Each phase shifter 100 includes an arc-shaped cutout or "slot" 110 that is formed through the feed board 130 and the backplane 200 underlying the feed board 130. The pin 104 of each wiper support 101 extends through a respective one of the slots 110 into the interior of the antenna 1.

A RET actuator (not visible in FIG. 1) is mounted within the interior of the antenna 1. A linkage mechanism 300 connects an output member of the RET actuator to the wiper supports 101. The linkage mechanism 300 includes a coupling portion 314 and a linkage device 310. The coupling portion 314 connects the linkage device 310 to the output member of the RET actuator. The linkage device 310 acts to transfer movement of the output member of the RET actuator to multiple wiper supports 101.

In the depicted embodiment, the linkage device 310 comprises a multi-flange member that has a central region and four flanges 312 extending therefrom. Each flange 312 includes an internal lip 168 at a distal end thereof. The internal lip 168 defines a pair of guides 320, and the pin 104 of a respective one of the wiper supports 101 is mounted in each guide 320.

When the output member of the RET actuator moves, the multi-point connection member moves linearly within the antenna 1. As the pins 104 of the wiper supports 101 are received within the respective guides 320 formed in the flanges 312 of the linkage device 310, the linear movement of the linkage device 310 results in rotational movement of the wiper supports 101, which in turn causes the wiper printed circuit board 144 of each phase shifter 100 to rotate above its associated main printed circuit board 142, thereby changing a downtilt angle on the antenna beams formed by each of the arrays 120 of first frequency radiating elements 122. Thus, the linkage mechanism 300 provides a simple mechanism that can be used to simultaneously adjust a large number of phase shifters 100.

The foregoing is illustrative of the present disclosure and is not to be construed as limiting thereof. Although exemplary embodiments of this invention have been described, those skilled in the art should readily appreciate that many variations and modifications are possible in the exemplary embodiments without materially departing from the novel teachings and advantages of this invention. Accordingly, all such variations and modifications are intended to be included within the scope of this invention as defined in the claims. The invention is defined by the following claims, with equivalents of the claims to be included therein.

That which is claimed is:

1. A linkage device of a linkage mechanism for a base station antenna, comprising:

a body;

a flange extending outwardly from the body;

a mounting portion extending from the body and configured to mount the linkage device within the base station antenna, and a coupling portion that is configured to couple the linkage device to a drive mechanism of the base station antenna, wherein the flange includes a guide that is coupled to a moveable element of a phase shifter of the base station antenna.

2. The linkage device according to claim 1, wherein the flange includes a first portion and a second portion, and the guide is formed between the first portion and the second portion.

3. The linkage device according to claim 2, wherein the first portion and the second portion are arranged substantially parallel to each other, with the edges of the first portion and the second portion that define the gap serving as the guide.

4. The linkage device according to claim 2, wherein one or more ribs extend between the first portion and the second portion that connect the first portion and the second portion to each other.

5. The linkage device according to claim 1, wherein the linkage device comprises a plurality of flanges, each flange including at least two guides.

6. The linkage device according to claim 5, wherein the guides of the plurality of flanges are in the same plane or a curved surface.

7. The linkage device according to claim 5, wherein the guides of the plurality of flanges are configured to be in staggered arrangement or at an angle to each other in a longitudinal direction.

8. The linkage device according to claim 1, wherein the linkage device comprises four flanges, each flange including two guides.

9. The linkage device according to claim 1, wherein the coupling portion is provided on a side of the body that is opposite the mounting portion.

10. A linkage mechanism for a base station antenna, comprising:

the linkage device according to claim 1; and a support device, the mounting portion of the linkage device being slidably mounted to the support device.

11. The linkage mechanism according to claim 10, wherein the support device has an L-shape and includes a longitudinal portion and a lateral portion, the mounting portion of the linkage device being slidably mounted to the lateral portion.

12. The linkage mechanism according to claim 11, wherein the lateral portion is provided with a mounting hole, the mounting portion of the linkage device passing through the mounting hole and being slidable relative to the mounting hole.

13. The linkage mechanism according to claim 12, wherein the mounting hole is provided with a bushing, the mounting portion of the linkage device engaging the bushing and being slidable relative to the bushing.

14. The linkage mechanism according to claim 10, wherein the support device is further provided with a guide rail that is configured to receive and guide at least one cable.

15. A base station antenna, comprising:

a plurality of backplanes that combine to form an internal space of the base station antenna;

a phase shifter mounted on a first of the backplanes and having a wiper support; and the linkage mechanism according to claim 1, the linkage mechanism being arranged in the internal space, wherein the wiper support of the phase shifter is received in the guide of the linkage device such that movement of the linkage device causes movement of the wiper support.

16. The base station antenna according to claim 15, wherein the wiper support includes a guide pin that is received within the guide and is configured to be slidable in the guide during operation of the linkage mechanism.

17. The base station antenna according to claim 15, wherein the longitudinal portion of the support device of the linkage mechanism is fixed to one of the plurality of backplanes.

18. A method for assembling the base station antenna according to claim 15, comprising the following steps:

a) mounting the phase shifters on the plurality of backplanes;

b) interconnecting a first subset of the plurality of backplanes;

c) fixing the longitudinal portion of the support device of the linkage mechanism to a first of the backplanes in the first subset of the plurality of backplanes;

d) mounting the linkage device to the support device;

e) engaging the wiper support of the phase shifter on the first of the backplanes in the first subset of the plurality of backplanes with the guide of the flange of the linkage device; and f) interconnecting a second subset of the plurality of backplanes with the first subset of the plurality of backplanes to define an internal space of the base station antenna so that the linkage mechanism is located within the internal space, and engaging the wiper support of the phase shifter on the second backplane correspondingly with the guide of the flange of the linkage device.

* * * * *